United States Patent [19]

Matsushima et al.

[11] Patent Number: 4,661,669

[45] Date of Patent: Apr. 28, 1987

[54] MICROWAVE OVEN WITH IMPROVED COOLING ARRANGEMENT

[75] Inventors: Kazufumi Matsushima, Aichi; Takamichi Sujaku, Nagoya, both of Japan

[73] Assignee: Kabushiki Kaisha Toshiba, Kawasaki, Japan

[21] Appl. No.: 838,786

[22] Filed: Mar. 12, 1986

[30] Foreign Application Priority Data

Mar. 14, 1985 [JP] Japan ..... 60-36484[U]
May 16, 1985 [JP] Japan ..... 60-104435
Aug. 23, 1985 [JP] Japan ..... 60-185509
Aug. 23, 1985 [JP] Japan ..... 60-185510

[51] Int. Cl.[4] ..... H05B 6/64

[52] U.S. Cl. ..... 219/10.55 R; 219/10.55 B; 361/384

[58] Field of Search ..... 219/10.55 R, 10.55 E, 219/10.55 B; 312/236; 361/383, 384; 126/198

[56] References Cited

U.S. PATENT DOCUMENTS 4,028,519 6/1977 De Weese et al. ..... 219/10.55 R X
4,184,945 1/1980 Morgan et al. ..... 219/10.55 R X
4,410,779 10/1983 Weiss ..... 219/10.55 B X
4,549,054 10/1985 Aoyama ..... 219/10.55 R

FOREIGN PATENT DOCUMENTS 0121892 10/1984 European Pat. Off. .

*Primary Examiner*—Philip H. Leung
*Attorney, Agent, or Firm*—Schwartz, Jeffery, Schwaab, Mack, Blumenthal & Evans

[57] ABSTRACT

A microwave oven is provided with a machine chamber underside of a heating chamber, and a magnetron and a high-voltage transformer provided in the machine chamber are cooled by a pair of cooling fans also disposed in the machine chamber. One of the cooling fans driven directly by a fan motor cools the transformer and the other cooling fan cools the magnetron driven by the fan motor through transmission means, such as a belt. A frame-shaped member is provided in the machine chamber for defining the height of the chamber and for rigidifying the structure thereof, so that the outer diameters of the cooling fans can be effectively selected so as to reduce noise and vibration caused in the machine chamber.

12 Claims, 10 Drawing Figures

MICROWAVE OVEN WITH IMPROVED COOLING ARRANGEMENT

BACKGROUND OF THE INVENTION

This invention relates to a high-frequency heating apparatus of a vertical type having a control portion provided below a front door, and more particularly to a microwave oven having an improved cooling mechanism provided in a machine chamber located rearwardly of the control portion.

Heretofore, microwave ovens of a vertical type having a control portion provided upwardly or downwardly of the oven door provided at the front portion of the microwave oven have been widely known. In this type microwave oven, a machine chamber is provided upwardly or downwardly of a heating chamber provided in the microwave oven, and a high-frequency oscillator such as a magnetron and a high-voltage transformer are encased in the machine chamber together with other electrical parts. A cooling fan is also provided in the machine chamber for cooling the magnetron and the high-voltage transformer simultaneously. During the operation of the magnetron, the cooling fan is operated to introduce outside air into the machine chamber and to direct the same toward the magnetron and the high-voltage transformer.

However, because of the restriction requirement for the height of the microwave oven, i.e. the height of the machine chamber, the cooling fan having an outer diameter larger than the height of the machine chamber cannot be located therein. Furthermore, since it is difficult to arrange the magnetron and the high-voltage transformer in closely adjacent relation, these are ordinarily arranged in a spaced apart relation in the machine chamber.

As a consequence, it has been found difficult to cool the high-voltage transformer and the magnetron in use of a single cooling fan, and accordingly, a microwave oven provided with a pair of cooling fans has been proposed to cool the two units separately.

However, in this type of conventional microwave oven, the height of the machine chamber cannot always be constant because of the construction errors and the like, and in order to prevent the cooling fans from contacting the walls of the machine chamber, the ratio of the outer diameter of each fan to the height of the machine chamber cannot be increased as desired. Thus, a comparatively small value had to be selected for the diameter ratio, so that a problem of unsatisfactory cooling of the electrical parts occurs.

Furthermore, because of the production errors of the parts of the microwave oven, it is difficult to equalize the gaps formed between the outer periphery of the cooling fan and the upper and lower walls of the machine chamber. Unequal gaps between the fan blades of each fan and the upper and lower walls of the machine chamber render the flow of air delivered from the cooling fan to be unstable and create vibrations and noises in the machine chamber. In order to equalize the gaps, a fine position adjusting device for the cooling fan is required and the assembling operation of the microwave oven is thereby complicated.

For economizing the construction cost, there has been proposed a microwave oven having a construction wherein the two cooling fans are driven by a single motor through a power transmission device such as an endless belt. However, when a trouble occurs in the belt to make one or both of the cooling fans inoperative, a hazardous condition tends to occur in the magnetron and/or the high-voltage transformer. Particularly, the temperature of the magnetron rises rapidly in comparison with the high-voltage transformer, so that it will be required to strictly watch or monitor the temperature rising of the magnetron.

Moreover, there remain several points to be improved for the conventional microwave oven such as improved ventilation or air exhausting condition in the machine chamber and the arrangement of the electric parts or components in the machine chamber for improving the air flowing effect therein.

SUMMARY OF THE INVENTION

An object of the invention is to provide a microwave oven for eliminating the above described difficulties of the conventional constructions, enhancing the cooling effect in the machine chamber of the microwave oven, and reducing the vibration and noises of the machine chamber.

Another object of the invention is to provide a microwave oven wherein the ratio of the outer diameter of each cooling fan to the height of the machine chamber is selected to a large value and the deviation in the height of the machine chamber caused by the production error can be substantially reduced.

Still another object of the invention is to provide a microwave oven wherein the cooling effect for the electrical parts provided in the machine chamber is improved, the flow of a high-temperature cooling air through the chamber is restricted, while the flow of fresh air of high cooling capability is enhanced to elongate the operational life of the electrical parts.

Still another object of the invention is to provide a microwave oven wherein an abnormal high temperature caused in the machine chamber by a trouble in the cooling system is constantly detected to thereby prevent the occurrence of fire hazard in the machine chamber.

These and other objects of this invention can be achieved by a microwave oven comprising a casing, heating chamber provided in the casing, a machine chamber provided in the casing at a position below the heating chamber, a high-voltage transformer and a high-frequency oscillator provided in the machine chamber, a pair of cooling fans of an equal construction provided in the machine chamber such that the cooling fans are placed in opposition to the high-voltage transformer and the high-frequency oscillator, respectively, one of the cooling fans being directly coupled to a driving shaft of a fan motor, while the other of the cooling fans being driven through a transmission device by the fan motor, louver means for receiving outside air into the casing, louver means for exhausting internal air to outside of the casing, and a heating chamber supporting member having an upper end fixedly supporting a bottom plate of the heating chamber and a lower end secured to a bottom plate of the machine chamber constituting a bottom plate of the casing, thereby defining a constant height of the machine chamber.

Preferably, the cooling fans are mounted on the heating chamber supporting member.

Preferably, the gaps formed between the periphery of each cooling fan and the bottom plates of the heating chamber and the machine chamber are substantially made equal, while the outer diameter of each cooling fan is held less than 85% of the height of the machine chamber.

Furthermore, when it is assusmed that a letter X represents a distance between the cooling fan directly driven by the fan motor and a side plate of the machine chamber, closely adjacent to the cooling fan and a letter Y represents a distance between the cooling fan driven indirectly through a transmission device and a side plate of the machine chamber, closely adjacent to the cooling fan, a further preferred embodiment of the invention may be provided by restricting the distances X and Y so as to satisfy the following relations.

$X < Y$ and $Y > 30$ mm

DESCRIPTION OF THE PREFERRED EMBODIMENT

Figure 1:
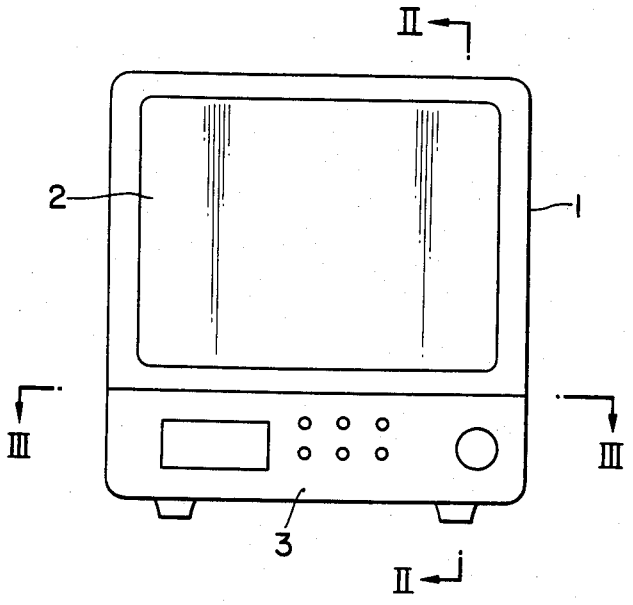
FIG. 1 is a front view of a microwave oven according to this invention.
Figure 2:
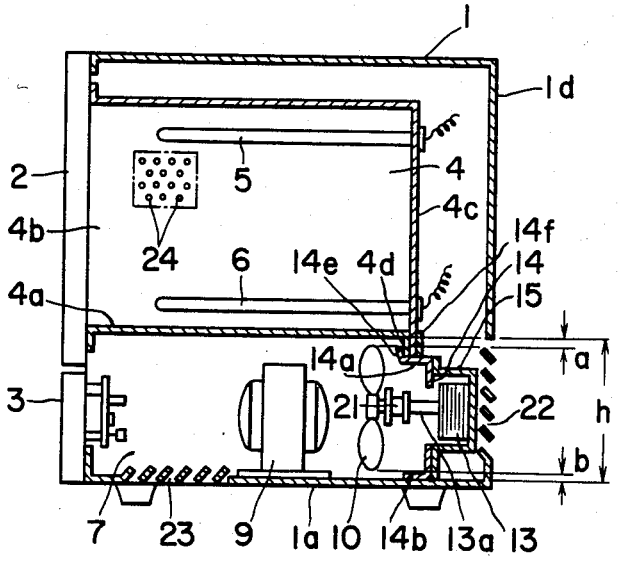
FIG. 2 is a sectional view taken along the line II—II in FIG. 1.

FIG. 1 is an elevational view showing the front side of a microwave oven according to this invention. As is apparent from FIG. 1, an oven door 2 is provided at a front portion of a casing 1 as an oven cabinet of the microwave oven and a control panel 3 is provided below the oven door 2. As shown in FIG. 2, the casing 1 is provided with a heating chamber 4 in which an upper heater 5 and a lower heater 6 are located.

Figure 3:
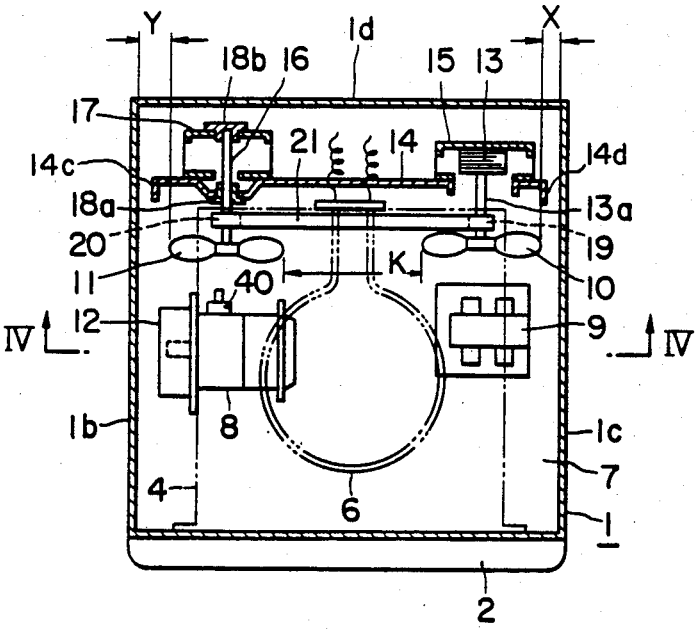
FIG. 3 is a sectional view taken along the line III—III in FIG. 1.
Figure 4:
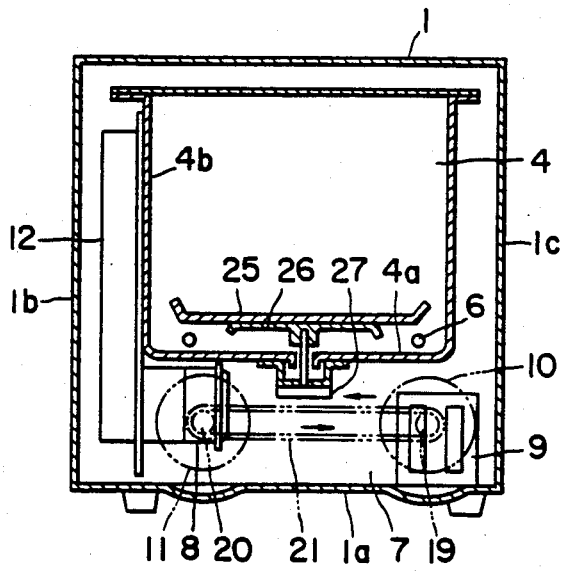
FIG. 4 is a sectional view taken along the line IV—IV in FIG. 3.

A machine chamber 7 is defined below the heating chamber 4, that is, between the bottom plate 4*a* of the heating chamber 4 and the bottom plate 1*a* of the casing 1. A high-frequency oscillator such as a magnetron 8, a high-voltage transformer 9, first and second cooling fans 10 and 11 and other electrical parts used for the operation of the oven are provided and arranged in the machine chamber 7 as shown in FIGS. 3 and 4. In the illustrated embodiment, the magnetron 8 and the high-voltage transformer 9 are arranged in the machine chamber 7 intermediately with respect to the forward-and-afterward direction, so that the magnetron 8 is positioned adjacent to a left-side wall 1*b* of the casing 1, while the high-voltage transformer 9 is positioned adjacent to a right-side wall 1*c* of the oven casing 1. The magnetron 8 is secured to the lower end of a waveguide 12 fixedly mounted outside of the left-side wall 4*b* of the heating chamber 4. The magnetron 8 delivers a high-frequency electromagnetic wave into the heating chamber 4 through the wave-guide 12 and a wave supplying port formed through the left-side wall 4*b*.

The first cooling fan 10 is located rearwardly of the high-voltage transformer 9 in a spaced apart relation, whereas the second cooling fan 11 is located rearwardly of the magnetron 8 in a spaced apart relation from the magnetron 8. The first cooling fan 10 is directly coupled to a driving shaft 13*a* of a fan motor 13 which is secured through a mounting plate 15 to a heating chamber supporting member 14. On the other hand, the second cooling fan 11 is coupled with a rotating shaft 16 which is rotatably supported by bearings 18*a* and 18*b*. A rotating shaft supporting plate 17 secured to the heating chamber supporting member 14 supports the bearings 18*a* and 18*b* in a fixed relation. In order to transmit power from the fan motor 13 to the shaft 16 of the second cooling fan 11, first and second pulleys 19 and 20 are fixedly mounted on the driving shaft 13*a* and the rotating shaft 16, respectively, and an undless belt 21 is extended around the pulleys 19 and 20. Upon energization of the fan motor 13, the first cooling fan 10 is directly driven by the fan motor 13, while the second cooling fan 11 is driven by a driving force of the fan motor 13 transmitted through the pulley-and-belt combination.

The heating chamber supporting member 14 is made of formed metal strips each having a substantially L-shaped cross section. After assembling the metal strips, the heating chamber supporting member 14 exhibits a substantially rectangular frame-like configuration having an upper side portion 14*a*, lower side portion 14*b* and two lateral side portions 14*c* and 14*d*. Among these portions of the member 14, the lower side portion 14*b* is secured to a bottom plate 1*a* of the casing 1 which constitutes the bottom place of the machine chamber 7. The upper side portion 14*a* of the member 14, on the other hand, has a forward end portion further bent upward so as to form a forward holding portion 14*e*, and an intermediate portion which is partly raised so as to provide a rearward holding portion 14*f*. Between the forward and rearward holding portions 14*e* and 14*f*, the rearward end of the bottom plate 4*a* of the heating chamber 4 and the low end of the rear plate 4*c*, which are joined together at 4*d*, are supported, and the rear plate 4*c* is secured to the rearward holding portion 14*f* by means of screws. In this manner, the distance between the bottom plate 1*a* of the machine chamber 7 and the bottom plate 4*a* of the heating chamber 4, that is, the height h of the machine chamber 7, is maintained at a predetermined value defined by the heating chamber supporting member 14.

The first and second cooling fans 10 and 11 are secured through the motor mounting plate 15 and the rotating shaft supporting plate 17 to the heating chamber supporting member 14, respectively, such that a first gap a formed between the blades of the cooling fans and the bottom plate 4*a* of the heating chamber 4 is substantially made equal to a second gap b formed between the blades of the fans and the bottom plate 1*a* of the casing 1 (FIG. 2). In this manner, the flowing directions of the cooling air caused by the cooling fans 10 and 11 are made substantially in parallel.

Furthermore, the blades of the cooling fans 10 and 11 are made of, for instance, a synthetic resin of flexible nature, such as polypropylene resin and the like. The first and second cooling fans 10 and 11 as well as the parts such as fan motor 13, rotating shaft 16, and bearings 18*a*, 18*b* are arranged at positions away from directly underneath the lower heater 6 provided in the heating chamber 4, and therefore the adverse effects caused by the lower heater 6 to these electric units and parts during the heating operation of the oven can be substantially eliminated.

Through a rear plate 1*d* of the casing 1 are formed ventilation holes 22 of, for instance, louver-shape. In addition, ventilation holes 23 of louver-shape are provided through the bottom plate 1*a* of the casing 1 at forward positions from the cooling fans 10 and 11, and a plurality of punched holes 24 are further provided through the left-side plate 4*b* of the heating chamber 4 at positions forward from the inlet port of the high-frequency wave.

When the cooling fans 10 and 11 are operated, outside air is guided through the ventilation holes 22 provided through the rear plate 1*d* into the machine chamber 7. The air delivered from the cooling fan 10 is used for cooling the high-voltage transformer 9, while the air delivered from the second cooling fan 11 is used for cooling the magnetron 8. The air cooled the high-voltage transformer 9 is exhausted outside through one part of the ventilation holes 23 provided forwardly of the high-voltage transformer 9, whereas one part of air used for cooling the magnetron 8 is guided upward along the left-side plate 4*b* of the heating chamber 4 and delivered into the heating chamber 4 through the punched holes 24 for renewing air in the chamber. Remaining part of air which cooled the magnetron 8 is exhausted outside through the other part of the ventilation holes 23 provided forwardly of the magnetron 8.

In the heating chamber 4, there is provided a rotating plate 25 of a dish-shape as shown in FIG. 4. The rotating plate 25 is secured to a rotating disc 26 which is rotatably supported by a spindle, not numbered, projecting upwardly from a central portion of the bottom plate 4*a* of the heating chamber 4. A motor 27 is coupled to the spindle for rotating the same.

In the microwave oven of the above described construction, the lower side portion 14*b* of the heating chamber supporting member 14 is secured to the bottom plate 1*a* of the casing 1, while the joined portion 4*d* of the rear end of the bottom plate 4*a* and the lower end of the rear plate 4*c* of the heating chamber 4 is inserted between the forward and rearward holding portions 14*e* and 14*f* formed on the upper side portion 14*a* of the heating chamber supporting member 14 and secured therein by means of machine screws. As a consequence, the distance between the bottom plate 1*a* of the casing 1 and the bottom plate 4*a* of the heating chamber 4, that is the height h of the machine chamber 7, is defined by the heating chamber supporting member 14 to be a constant value, and the possibility of deviation caused by the production errors and assembling errors can be substantially eliminated. Thus, it is not necessary to provide large spacings between the periphery of the first and second cooling fans 10 and 11 and the bottom plate 4*a* of the heating chamber 4 and also between the periphery of these fans and the bottom plate 1*a* of the oven structure 1, respectively, for preventing the fans 10 and 11 from touching the walls of the machine chamber 7 during the operation of these cooling fans, and hence the ratio of the outer diameter of the cooling fans 10 and 11 to the height of the machine chamber can be determined to be higher in comparison with the prior art construction. As a consequence, the diameter of the cooling fans 10 and 11 can be increased and the cooling effect of the electric parts can be improved accordingly.

Furthermore, since the deviation caused in the height of the machine chamber 7 by the production error and assembling error can be eliminated as described before, a gap a produced between the cooling fans 10 and 11 and the bottom plate 4*a* of the heating chamber 4 and a gap b produced between the cooling fans 10 and 11 and the bottom plate 1*a* of the casing 1 can be equalized precisely. As a result, instability in the flow of air passing through the machine chamber 7 and the noise thereby caused can be substantially reduced and the complication of the assembling operation due to the positional adjustment of the cooling fans can be eliminated.

In the above described construction, since the first and second cooling fans 10 and 11 are supported by the heating chamber supporting member 14 having the lower side portion 14*b* secured to the bottom plate 1*a* and the upper side portion 14*a* secured to the joined end portion 14*d* of the bottom plate 4*a* and the rear plate 4*c* of the heating chamber 4 by means of machine screws, the structure supporting cooling fans 10 and 11 can be strengthened and the creation of vibration can be prevented.

In addition, the first and second cooling fans 10 and 11 as well as the fan motor 13 and the bearings 18*a* and 18*b*, which are secured to the shaft supporting plate 17 fixed to the heating chamber supporting member 14, are placed at positions departed from directly underneath the lower heater 6 so that the probability of these members being damaged by the heat of the lower heater 6 is reduced. As a consequence, the occurrence of thermal deformation in the sliding parts of the rotating shaft 16 and the bearings 18*a* and 18*b* can be prevented thereby stabilizing the rotations of the cooling fans 10 and 11. In addition, the necessity of utilizing heat-insulating materials in the construction of the cooling fans can be eliminated. Thus, the cooling fans 10 and 11 may also be made of a flexible synthetic resin such as polypropylene, and production cost of these fans can be reduced, thus also reducing noises created therein.

In a more practical embodiment of this invention, the outer diameters of the first and second cooling fans are selected to be less than 85% of the height h of the machine chamber, defined by the distance between the bottom 1*a* of the casing 1 and the bottom plate 4*a* of the heating chamber 4, while the distance K between the two fans 10 and 11 is selected to be equal to, or larger than the outer diameters of the cooling fans 10 and 11. Furthermore, when it is assumed that a letter X represents a distance between the tip of the first cooling fan 10 directly driven by the fan motor 13 and the rightward side plate 1*c* forming the machine chamber 7 and a letter Y represents a distance between the tip of the second cooling fan 11 driven through the belt 21 and the leftward side plate 1*b* forming the machine chamber 7, the first and second cooling fans 10 and 11 are arranged to satisfy the following relation.

$$X < Y \text{ and } Y > 30 \text{ mm}$$

Figure 5:
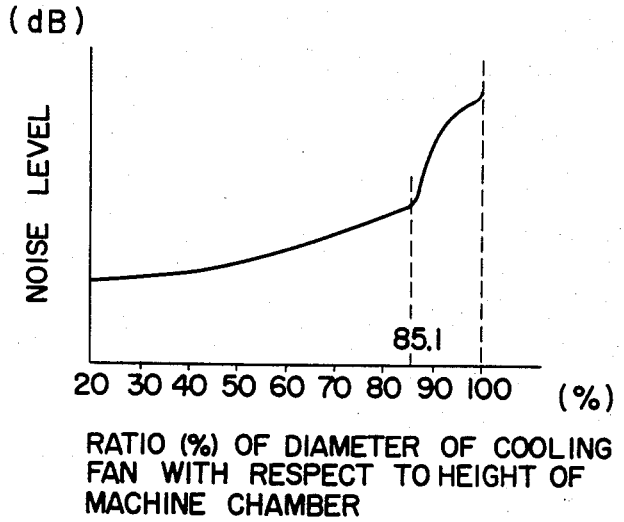
FIG. 5 is a characteristic curve showing a relation between the noise level created by the microwave oven and the ratio of the outer diameter of each of the first and second cooling fans against the height of a machine chamber provided in the microwave oven.

FIG. 5 shows a relation between the noise level and the diameter of the cooling fans expressed in ratio to the height h of the machine chamber 7. When the diameter expressed in ratio is less than 85%, the variation of the noise level is comparatively low, but when the ratio is larger than 85%, resonance and vibration occur in the oven and the noise level increases abruptly. When it is assumed that the cooling fans 10 and 11 have an equal diameter, and a letter a represents the distance between the cooling fans and the bottom plate 4*a* of the heating chamber, while a letter b represents the distance between the cooling fans and the bottom plate 1*a* of the casing as described hereinbefore, it is found that the noise level in the case of the distances a and b being made equal is lower than that of the case where the distances a and b are different.

In the above described embodiment of this invention, since the distance a is substantially made equal to the distance b while the outer diameters of the first and second cooling fans are selected to be less than 85% of the height h of the machine chamber 7, the occurrence of resonance and vibration in the oven as well as the generation of noises can be substantially reduced.

Figure 6:
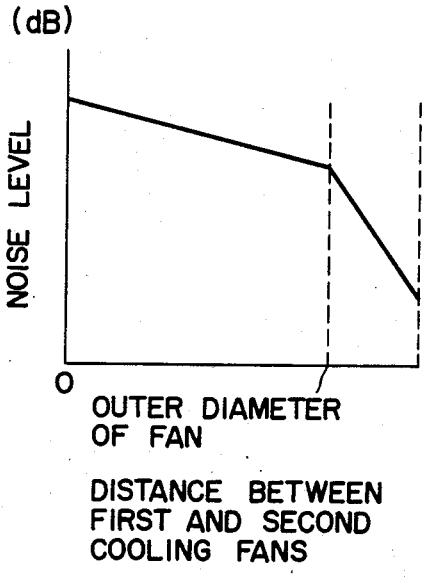
FIG. 6 is a characteristic curve showing a relation between the noise level and the distance between the two cooling fans.

FIG. 6 is a graph showing a relation between the noise level and the distance between the first and second cooling fans. As is apparent from FIG. 6, the noise level is abruptly reduced when the distance K between the first and second cooling fans is made greater than the outer diameter of the cooling fans. Accordingly, when the blowing directions of the cooling fans are made substantially in parallel and the distance K between the two fans is made larger than the outer diameter of the cooling fans, the interference between the cooling air delivered by the cooling fans can be prevented and the generation of noises can be reduced.

Furthermore, in this embodiment, the distance X between the first cooling fan 10 and the right side plate 1*e* and the distance Y between the second cooling fan 11 and the left side plate 1*b* have been so selected that the relation $$X<Y \text{ and } Y>30 \text{ mm}$$

is satisfied. As a consequence, the noises created by the first and second cooling fans can be balanced with each other regardless of a case where the first cooling fan 10 driven by the fan motor 13 is rotated stably while the second cooling fan 11 driven through the belt 21 is rotated unstably due to the slip of the belt and the like.

Figure 7:
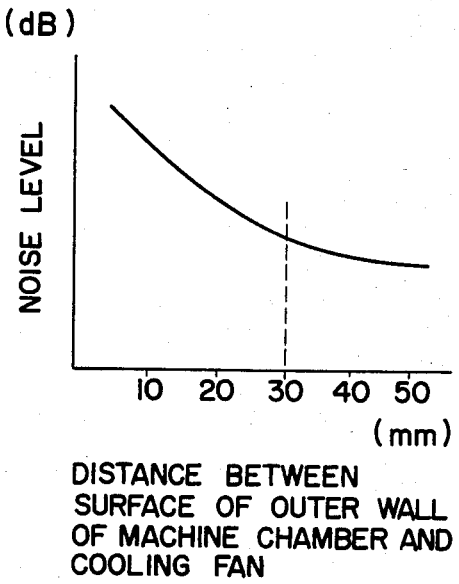
FIG. 7 is a characteristic curve showing a relation between the noise level and the distance between the second cooling fan and the left-side wall of the machine chamber in a case where the second cooling fan is rotated at 2500 rpm.

FIG. 7 indicates test results regarding a relation between the distance Y and the noise level in a case where the second fan is rotated at a speed of 2500 rpm. From FIG. 7, it is apparent that when the distance Y between the second cooling fan 11 and the left-side plate 1*b* of the machine chamber 7 is selected to be larger than 30 mm, the noise level in the chamber can be substantially reduced.

Figure 8:
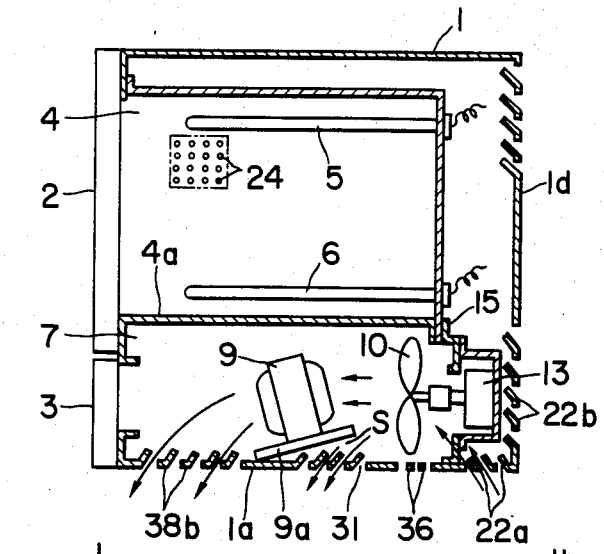
FIG. 8 is a sectional view similar to FIG. 2, showing another embodiment of this invention.
Figure 9:
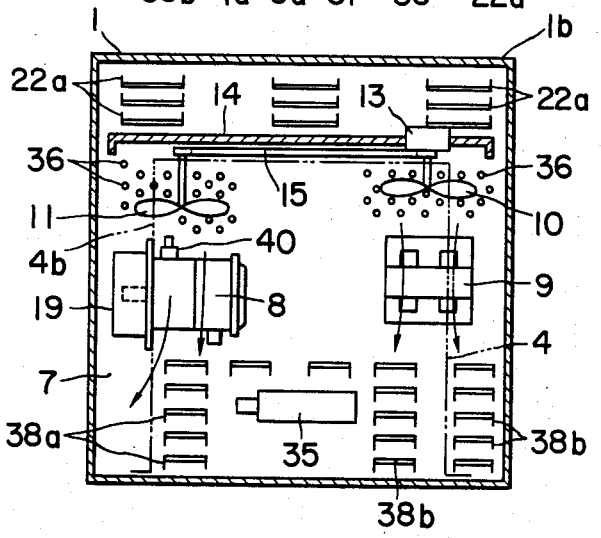
FIG. 9 is a sectional view similar to FIG. 3, showing the embodiment shown in FIG. 8.

FIGS. 8 and 9 illustrate still another embodiment of this invention, wherein similar members to those in FIGS. 1 through 4 are designated by similar reference numerals, and detailed description thereof is omitted for avoiding redundancy.

In FIGS. 8 and 9, punching holes 36 are provided through the bottom plate 1*a* of the oven structure 1 at positions below the cooling fans 10 and 11, while louvers 22*a* and 22*b* are provided through the bottom plate 1*a* and the rear plate 1*d* at positions lower and rearward sides of the cooling fans 10 and 11, respectively. The louvers 22*a* and 22*b* are formed such that the cut-and-raised edges thereof are disposed forwardly and upwardly. Also, through the portions of the bottom plate 1*a* on the front side of the magnetron 8 and the high-voltage transformer 9 are provided first and second louvers 38*a* and 38*b* which are formed by cutting and raising the bottom plate 1*a* rearwardly upwardly. According to this construction, when the cooling fans 10 and 11 are operated, cooling air is supplied from outside of the oven into the machine chamber 7 efficiently through the punching holes 36 and the louvers 22*a* and 22*b* and forced toward the magnetron 8 and the transformer 9 by the cooling fans 10 and 11. Most part of air which cooled the magnetron 8 is exhausted outside through the first louvers 38*a*, while most part of air which cooled the transformer 9 is exhausted outside through the second louvers 38*b*. According to this embodiment, the magnetron 8 is provided in the machine chamber 9 slightly forwardly from the position of the high-voltage transformer 9 as is apparent from FIG. 9. Furthermore, the number of the first louvers 38*a* provided forwardly from the magnetron 8 is selected to be less than that of the second louvers 38*b* provided forwardly from the transformer 9, and hence the total opening area of the first louvers 38*a* is less than that of the second louvers 38*b*. A high-voltage condenser 35 may be provided in the machine chamber 7.

Figure 10:
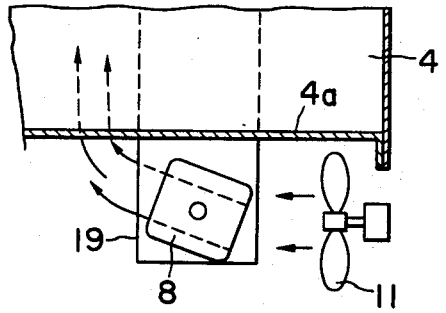
FIG. 10 is a diagram showing an alternation of an arrangement of a magnetron.

As is apparent from FIG. 10, the magnetron 8 of this embodiment provided in the machine chamber 7 is disposed obliquely. That is, the downstream side of the magnetron 8 is made higher than the upstream side of the same and the magnetron 8 is secured to the waveguide in the obliquely disposed state.

Conversely, the high-voltage transformer 9 is preferably provided in the chamber 7 obliquely as shown in FIG. 8, such that the mounting base portion 9*a* of the high-voltage transformer 9 disposed rearwardly upwardly so that a space S opening rearwardly is formed between the portion 9*a* and the bottom plate 1*a*. Other louvers 31 tapering rearwardly upwardly may be provided in the space S for creating turbulence of air and improving the cooling effect of the high-voltage transformer 9.

In the above described embodiment, the magnetron 8 and the high-voltage transformer 9 are disposed in alignment with the flowing direction of the cooling air as described above, and a number of louvers and punching holes are provided through the bottom plate 1*a* and the side plate 1*b* suitably. As a consequence, a sufficient quantity of cooling air can be supplied into the machine chamber 7, and the magnetron 8, high-voltage transformer 9 and other electrical parts are thereby cooled efficiently. At this time, the substantial part of air which cooled the transformer 9 is exhausted outside through the second louvers 38*b*, while most part of air which cooled the magnetron 8 is exhausted outside through the first louvers 38*a*, excepting that a part of air which cooled the transformer 9 is guided upward into the heating chamber 4 for the purpose of changing air. As described hereinabove, the provision of the louvers and the punching holes can reduce the resistance of air flowing through the machine chamber 7 and the cooling efficiency due to the cooling fans can be improved.

More specifically, since the total opening area of the first louvers 38*a* is selected to be less than that of the second louvers 38*b*, the amount of air cooling the magnetron 8 and flowing upward into the heating chamber 4 through the punching holes 24 can be increased and smooth flow of the cooling air can be thereby assured.

Furthermore, since the magnetron 8 is disposed obliquely upwardly and secured to the wave-guide 19 in this state, the air cooling the magnetron 8 is smoothly guided upward along the leftside plate 4*b* into the heating chamber 4.

In addition, since the high-voltage transformer 9 is disposed rearwardly upwardly and the louvers 31 provided in the space S formed between the inclined transformer 9 and the bottom plate 1*a* are also tapered rearwardly upwardly, a part of cooling air introduced into the space S is agitated by the edges of the louvers 31 and the resultant cooling air heated to a high temperature is exhausted outside through the louvers 31, thus further improving the cooling efficiency.

In this embodiment, the high-voltage transformer 9 is cooled by the cooling fan 10 directly driven by the fan motor 13, while the magnetron 8 is cooled by the cooling fan 11 which is driven by the fan motor 13 through the belt 21. Furthermore, a thermal switch 40 connected to the power source side of the magnetron 8 is provided outside of the magnetron 8. Accordingly, when the operation of the cooling fan 11 for cooling the magnetron 8 is interrupted, for instance, by a belt breaking accident, thereby increasing the magnetron temperature, or when the temperature of the heating chamber 4 exceeds a predetermined value, the thermal switch 40 is operated to interrupt the power source of the magnetron 8. At this time, however, the high-voltage transformer 9 is continuously cooled by the cooling fan 10, while the operation of the magnetron 8 is interrupted each time when the temperature of the magnetron 8 or the heating chamber 4 goes up abruptly, and the safety of the oven can be thereby assured.

Although various embodiments of the invention have been described above, it is apparent that the invention is not necessarily restricted to the above described embodiment, and various modifications and alterations may otherwise be carried out without departing from the scope of this invention.

What is claimed is:

1. A microwave oven with an improved cooling arrangement, comprising:

a casing;

a heating chamber provided in said casing and having a bottom plate;

a machine chamber provided in said casing at a position below said heating chamber and having a bottom plate;

a high-voltage transformer and a high-frequency oscillator provided in said machine chamber wherein said transformer and said oscillator are secured onto the bottom plate of said machine chamber at positions spaced laterally apart from each other;

a pair of cooling fans provided in said machine chamber for cooling said high-voltage transformer and said high-frequency oscillator, respectively;

an electric motor for driving one of said cooling fans directly and the other of said cooling fans indirectly through transmission means wherein each fan is rotated in a vertical plane in said machine chamber;

venting inlet means for introducing outside air into said casing;

venting outlet means for exhausting air provided inside to outside of said casing; and means, including a supporting member of a substantially rectangular frame-like configuration disposed vertically in said machine chamber and having an upper end secured to the bottom plate of said heating chamber and a lower end secured to the bottom plate of said machine chamber, for maintaining a constant height of said machine chamber at least at a portion thereof adjacent to said cooling fans.

2. A microwave oven according to claim 1 wherein said cooling fans are supported by said heating chamber supporting member.

3. A microwave oven according to claim 1 wherein a first spacing between a peripheral edge of each of the cooling fans and said bottom plate of said heating chamber is substantially made equal to a second spacing between a peripheral edge of each of said cooling fans and said bottom plate of said machine chamber and the outer diameter of each of said cooling fans is held to be less than 85% of said height of said machine chamber.

4. A microwave oven according to claim 1 wherein the following relations are satisfied:

$$X<Y \text{ and } Y>30 \text{ mm}$$

where it is assumed that a letter X represents a distance between the cooling fan directly driven by said fan motor and a nearmost side plate of said machine chamber and a letter Y represents a distance between the cooling fan driven through said transmission device and a nearmost side plate of said machine chamber.

5. A microwave oven according to claim 1 wherein said cooling fan directly driven by the fan motor is arranged to oppose said high-voltage transformer, while said cooling fan driven through said transmission means is arranged to oppose said high-frequency oscillator and wherein a protective switch is associated with said high-frequency oscillator for interrupting the same in response to the detection of an abnormal temperature of said high-frequency oscillator.

6. A microwave oven according to claim 1 wherein said high-voltage transformer and said high-frequency oscillator are arranged at forwardly and rearwardly intermediate positions in said machine chamber, said paid of cooling fans are provided in opposition to and in a spaced apart relation from the high-voltage transformer and the high-frequency oscillator, respectively, so that cooling air flows from said cooling fans are disposed mutually in parallel and a lateral distance between said cooling fans is so selected to be larger than the outer diameter of the cooling fans.

7. A microwave oven according to claim 1 wherein said high-frequency oscillator is provided in the machine chamber at a downstream position in comparison with a position of the high-voltage transformer with respect to the flowing direction of the cooling air.

8. A microwave oven according to claim 1 wherein said venting inlet means for introducing outside air is a plurality of louvers formed through a rear side plate of said machine chamber, while said venting outlet means for exhausting internal air to outside is a plurality of louvers formed through the bottom plate of said machine chamber at positions downstream from said high-voltage transformer and said high-frequency oscillator with respect to the flowing direction of the cooling air.

9. A microwave oven according to claim 8 wherein said louvers for exhausting internal air comprise first louvers provided downstream of said high-frequency oscillator and second louvers provided downstream of said high-voltage transformer, a total opening area of said first louvers being smaller than that of said second louvers.

10. A microwave oven according to claim 9 wherein said high-voltage transformer is held in an inclined state so that a rear portion thereof facing the cooling fan is disposed upwardly and third exhausting louvers are formed through the bottom plate of the machine chamber at a portion directly below the upwardly inclined high-frequency transformer.

11. A microwave oven according to claim 8 wherein said venting inlet means for introducing outside air includes louvers formed through said bottom plate of the machine chamber downstream side of said cooling fans.

12. A microwave oven according to claim 1 wherein said high-frequency oscillator is held in an inclined state so that a forward portion thereof far from the cooling fan is disposed upwardly to improve flowing direction of cooling air.

* * * * *